US011641961B2

(12) United States Patent
Zylberman et al.

(10) Patent No.: US 11,641,961 B2
(45) Date of Patent: May 9, 2023

(54) POST-SURGICAL PILLOW

(71) Applicant: PROTEKTIT PILLOW LLC, Englewood, NJ (US)

(72) Inventors: Rita Zylberman, Englewood, NJ (US); Debbie Friedman, Boca Raton, FL (US)

(73) Assignee: PROTEKTIT PILLOW LLC, Englewood, NJ (US)

( * ) Notice: Subject to any disclaimer, the term of this patent is extended or adjusted under 35 U.S.C. 154(b) by 56 days.

(21) Appl. No.: 17/179,768

(22) Filed: Feb. 19, 2021

(65) Prior Publication Data

US 2021/0259441 A1 Aug. 26, 2021

Related U.S. Application Data

(60) Provisional application No. 62/979,061, filed on Feb. 20, 2020.

(51) Int. Cl.
*A47G 9/10* (2006.01)
*A61G 13/12* (2006.01)

(52) U.S. Cl.
CPC ..... *A47G 9/1036* (2013.01); *A61G 13/121* (2013.01); *A47G 2009/1018* (2013.01)

(58) Field of Classification Search
None
See application file for complete search history.

(56) References Cited

U.S. PATENT DOCUMENTS

2013/0232693 A1* 9/2013 Myers ..... A47G 9/10 5/636
2015/0089742 A1* 4/2015 Aas-Jakobsen ..... A47G 9/1045 5/632
2019/0183267 A1* 6/2019 Pham ..... A41D 13/0518

OTHER PUBLICATIONS

7Stiches, My Surgery Sidekick, Mar. 10, 2019 (Year: 2019).*
Can J Surg, Lymphatic cording or axillary web syndrome after breast cancer surgery (Year: 2009).*

* cited by examiner

*Primary Examiner* — David R Hare
*Assistant Examiner* — Adam C Ortiz
(74) *Attorney, Agent, or Firm* — Myers Wolin, LLC

(57) ABSTRACT

A pillow is provided having an elongated main body having a first end and a second end and a length from the first end to the second end. The pillow may further have a first notch at a top edge of the elongated main body adjacent the first end and a second notch at the top edge of the elongated main body adjacent the second end. The pillow may then have a first pocket at an inner surface of the elongated main body between the first notch and a bottom edge of the elongated main body and a second pocket at the inner surface between the second notch and the bottom edge.

13 Claims, 2 Drawing Sheets

POST-SURGICAL PILLOW

CROSS REFERENCE TO RELATED APPLICATIONS

This invention claims the benefit of U.S. Provisional Patent Application No. 62/979,061, filed Feb. 20, 2020, the contents of which are incorporated by reference herein.

FIELD OF THE INVENTION

This disclosure relates to a protective post-surgical pillow for support and travel, with integrated pockets for cold or warm packs.

BACKGROUND

After major surgeries, such as mastectomy, patients are anxious to avoid pain or further injury at a surgical site. Such anxiety begins as soon as patients leave the hospital, as patients are often afraid of the shoulder strap on a seatbelt hurting then if they make a sudden stop while in a car on the way home from a hospital. Similar, patients may be worried that family would hug them, inadvertently causing further pain.

When coughing or sneezing, patients may need to hold something against their chest for counter-pressure, to limit the associated pain. Further, mastectomy patients may develop severe underarm pain where lymph nodes were removed, and it may be difficult to hold an ice pack against the site. Products exist to protect a patient's chest, and even to locate ice packs in certain situations, but no device exists that provides adequate protection while locating ice packs adjacent underarm pain sites on both sides.

Some pillows exist that provide protection to the chest area, with some underarm support. However, such pillows only stay in place by having the patient hold them against their sides with their arms, or by having a seatbelt hold it in place. In such products, when the patient uses their arms, the pillow may fall. As certain arm movements hurt, if such a pillow slips, retrieving it may be painful. Further, since such a pillow is used constantly, and may be used for several weeks at a time after surgery, it inevitably gets dirty. Though washable, this leaves the patient without my pillow for several hours and, as is often the case, it didn't feel quite the same after the washing.

Finally, when patients need to use an ice pack or a warm pack to help alleviate underarm pain, there was no way to hold it in place without the patient holding their arm tightly against their side. Even slight movements would then cause the icepack to slip. While pillows exist with pockets for ice packs, such small pillows are used for locating a single ice pack. Even underarm pillows of that type are designed for a single underarm location, and do not cover the chest region at all, and they do not stay in place.

There is a need for a post-surgical pillow that can protect a user's chest and underarm area, that can locate ice packs under each of a user's arms simultaneously and consistently, and that can remain properly positioned even when a user is active.

SUMMARY

The pillow shown and described is a post-surgical pillow designed to protect the chest after mastectomy, thoracic and/or cardiac surgery. The pillow is shaped to be held comfortably against the chest and underarms, providing both protection from external forces and support or splinting when needed. The pillow may lay comfortably under a vehicle seat belt shoulder strap in order to provide an added layer of protection while in the car. Integrated pockets under arms or in a front panel are designed to hold ice or warm packs against aching body parts, as needed. The pillow has a detachable cover for washing and a detachable and adjustable neck strap to free hands without dropping the pillow.

In some embodiments, the pillow comprises an elongated main body having a first end and a second end and a length from the first end to the second end. The pillow may further comprise a first notch at a top edge of the elongated main body adjacent the first end and a second notch at the top edge of the elongated main body adjacent the second end.

The pillow may then have a first pocket at an inner surface of the elongated main body between the first notch and a bottom edge of the elongated main body and a second pocket at the inner surface between the second notch and the bottom edge.

In some embodiments, the pillow further comprises first and second vertical grooves, each along the inner surface of the elongated main body and extending from the top edge to the bottom edge of the pillow. In such an embodiment, the first vertical groove divides a first side segment of the pillow from a middle segment and the second vertical groove divides a second side segment of the pillow from the middle segment.

The first side segment may then have the first notch and the first pocket and the second side segment may then have the second notch and the second pocket, and the pillow may then fold along the first and second vertical grooves such that it can wrap around the user.

In some embodiments, the pillow further comprises temperature control elements located in the first and second pockets. Such temperature control elements may be removable, or they may be sealed within the pockets.

The temperature control elements may be ice packs, for example. The pillow may further comprise detents adjacent the first and second pockets such that the temperature control elements can be at least partially embedded in the body of the pillow when the temperature control elements are located within their respective pockets.

In some embodiments, the first and second notch may each have inner and outer lips, where the inner lips are adjacent a middle section of the pillow and the outer lips are adjacent a corresponding edge of the elongated main body. In some such embodiments, a strap may be provided, where the strap extends from the inner lip of the first notch to the inner lip of the second notch. The strap may then be releasably fixed at each end by, for example, a Velcro connection.

In some embodiments, the elongated main body is filled with a granular fill or, alternatively, it may have a single piece or multiple piece foam fill. In some embodiments, the elongated main body has a removable cover that can be washed independently of the pillow.

In some embodiments, the elongated main body comprises three discrete pillow chambers, with a first chamber containing the first notch, a second chamber containing the second notch, and a third chamber being a central chamber between the first and second chambers.

In some embodiments, the pillow further comprises a third pocket centrally located on an inner surface of the elongated main body.

DETAILED DESCRIPTION OF THE PREFERRED EMBODIMENTS

Figure 1:
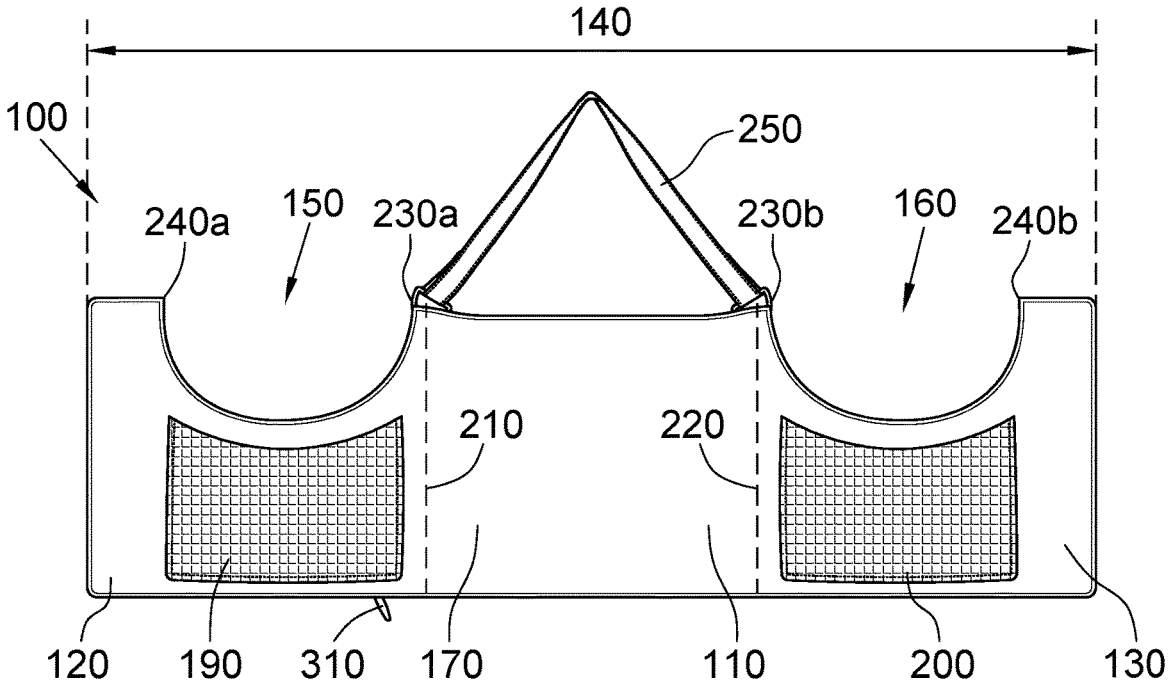
FIG. 1 provides an inner view of a pillow in accordance with this disclosure.

The description of illustrative embodiments according to principles of several illustrative embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits are illustrated by reference to certain exemplified embodiments and may not apply to all embodiments. Accordingly, the invention expressly should not be limited to such exemplary embodiments illustrating some possible non-limiting combination of features that may exist alone or in other combinations of features; the scope of the claimed invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
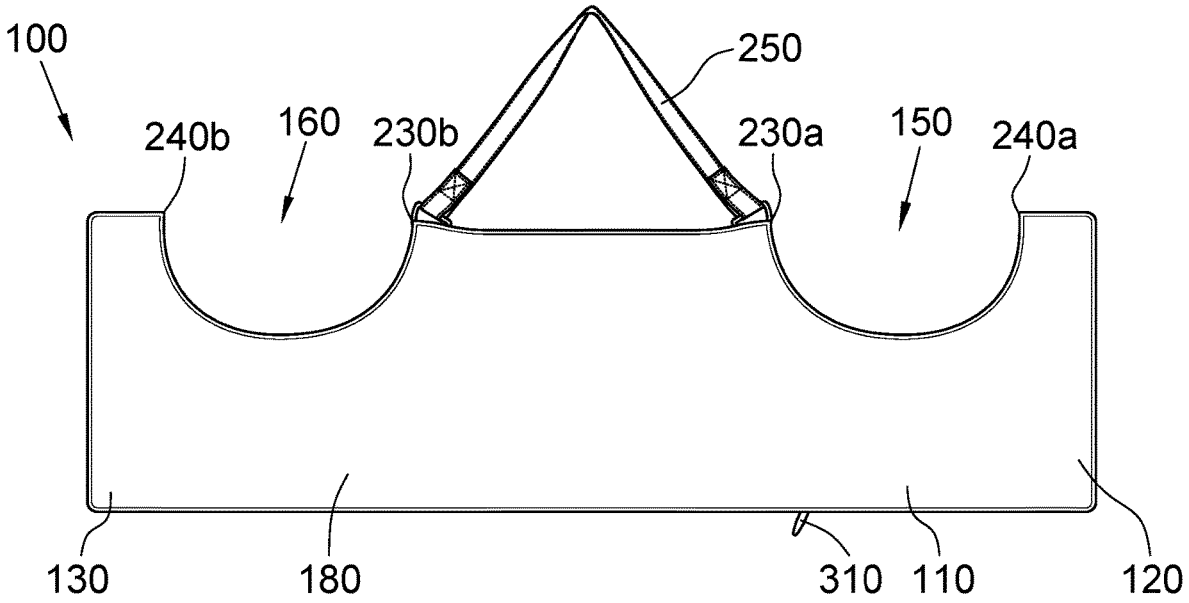
FIG. 2 provides an outer view of the pillow of FIG. 1.

The various embodiments described herein provide a post-surgical pillow. FIG. 1 provides an inner view of a pillow 100 in accordance with this disclosure. FIG. 2 provides an outer view of the pillow 100 of FIG. 1.

As shown, the pillow 100 has an elongated main body 110 which has a first end 120 and a second end 130 and a length 140 extending from the first end to the second end. The pillow then has a first notch 150 at a top edge of the elongated main body 110 adjacent the first end 120 and a second notch 160 at the top edge adjacent the second end 130.

The notches are typically used by a user as arm slots, such that a user may wrap the elongated main body 110 around their own body and then fix the pillow in location by placing their arms through the notches 150, 160. The pillow has an inner surface 170, shown in FIG. 1, and an outer surface 180, shown in FIG. 2. When a user wraps the elongated main body 110 around their own body, they do so with the inner surface 170 facing their own body. In some embodiments, this may be by way of grooves or other fold lines integrated into the elongated body 110, which allow the components of the elongated body to fold in the direction of the inner surface 170, as described in more detail below.

The pillow 100 is further provided with a first pocket 190 at the inner surface 170 of the elongated main body 110, located between the first notch 150 and a bottom edge of the elongated main body.

The pillow 100 is similarly provided with a second pocket 200 at the inner surface 170 of the elongated main body 110 located between the second notch 160 and the bottom edge of the elongated main body. The first and second pockets 190, 200 are typically sized to retain temperature control elements, such as ice packets, heat packs, or personal heating or cooling units.

The pockets 190, 200 are located under the notches 160, 170 so that, during use, temperature control elements located within the pockets are located in the underarm region. The fabric of the pockets 190, 200 protects a user's body from extreme temperatures, and therefore no additional cover for the temperature control element may be necessary.

In some embodiments, the pillow 100 includes such temperature control elements in the form of ice packs sized for the pockets 190, 200 provided. In some such embodiments, personal heating or cooling units may be permanently embedded into the pillow 100, and the pockets 190, 200 may be sealed. In other such embodiments, ice packs may be provided with the pillow 100, and the pockets are openable, such that the ice packs may be kept in a freezer independently of the pillow, and such that the ice packs may be changed as needed. In some embodiments, the pockets 190, 200 are sized for standard size ice packs, such as 4×6, such that users can easily by extra packs to keep in the freezer.

In some embodiments, the pillow may comprise detents adjacent the first and second pockets 190, 200, such that when the temperature control devices, such as the ice packs, are placed in the corresponding pockets, they are at least partially embedded in the elongated body 100 of the pillow 100. In such embodiments, the detents may be sized such that the temperature control elements do not fit fully within the detents and therefore extend partially out of the elongated main body 110 when located within their respective pockets 190, 200.

As discussed above, the elongated main body 110 of the pillow 100 may be provided with fold lines to allow the elongated body to easy wrap around a user. Accordingly, the pillow 100 may further comprise a first vertical groove 210 and a second vertical groove 220, each along the inner surface 170 of the elongated main body 110 and extending from the top edge to the bottom edge. The first vertical groove 210 would then divide a first side segment of the elongated main body 110, containing the first notch 150 and the first end 120 from a middle segment. Similarly, the second vertical groove 220 would divide a second side segment of the elongated main body 110, containing the second notch 160 and the second end 130 from the middle segment of the elongated main body 110.

The pillow 100 would then fold along the first vertical groove 210 and the second vertical groove 220 such that it can comfortably wrap around a user. Typically, such grooves would be provided only at the inner surface 170 of the elongated main body 110, such that the pillow can fold inward but not outward. It is understood that in some embodiments, no such grooves are provided, or some stitching may be provided in place of the grooves. In any event, when in use, the elongated main body 110 would be folded around a user with the pockets 190, 200 on the inner surface 170 adjacent the user's body.

In some embodiments, the elongated main body 110 comprises three discrete pillow chambers, with a first chamber containing the first notch 160, a second chamber containing the second notch 170, and a third chamber being a central chamber between the first and second chambers.

As shown, each of the first notch 150 and the second notch 160 have an inner lip 230*a, b*, and an outer lip 240*a, b*. The outer lip 240*a, b* of each notch 150, 160 is located adjacent the corresponding edge 120, 130 of the elongated main body 110. The inner lip 230*a, b* of each notch 150, 160 is adjacent the middle section of the elongated main body 110.

The pillow 100 further comprises a strap 250 which extends from the inner lip 230*a* of the first notch 150 to the inner lip 230*b* of the second notch 160. The strap 250 is then releasably fixed to the elongated main body 110 at the inner lips 230*a, b*. The strap may be fixed by a variety of releasable structures, such as Velcro, snaps, buttons, or the like.

Figure 3:
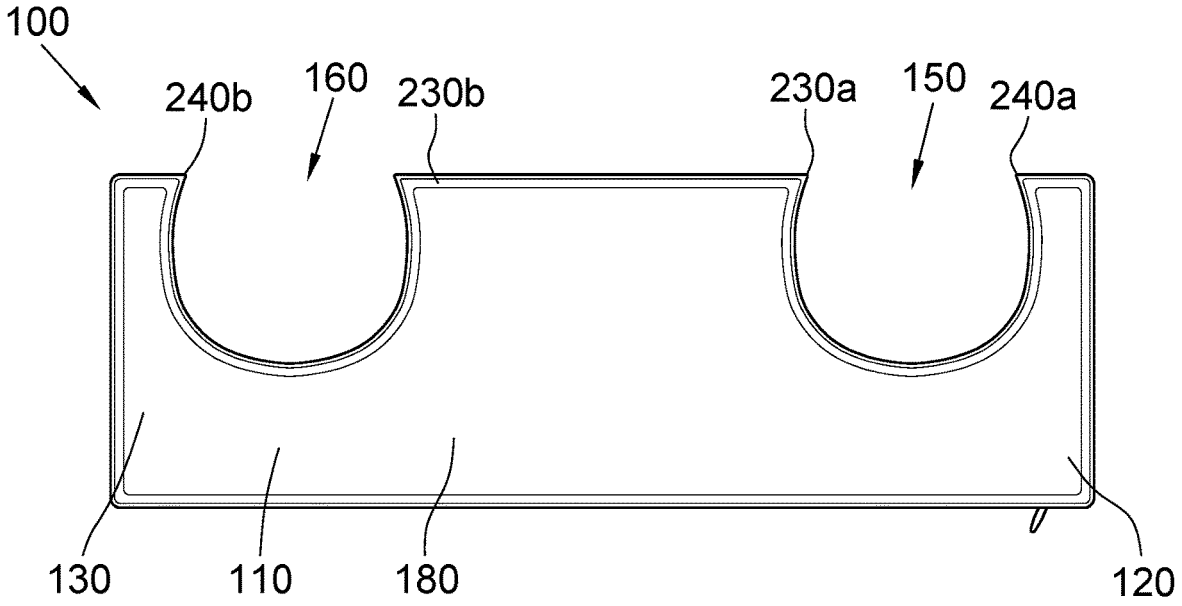
FIG. 3 provides an outer view of a second embodiment of a pillow in accordance with this disclosure.
Figure 4:
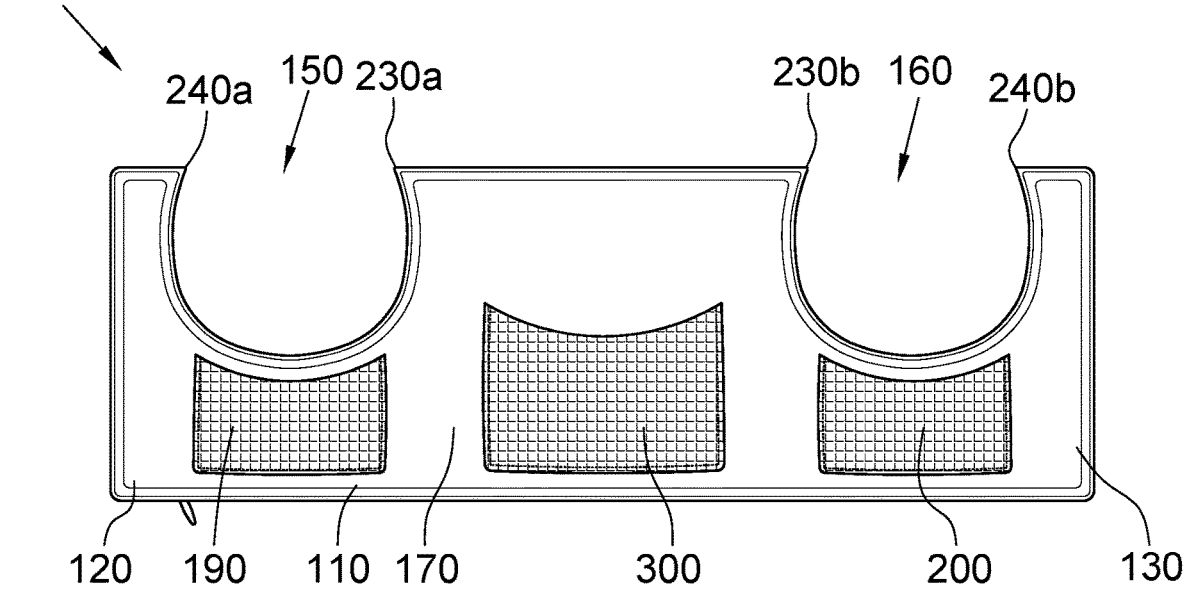
FIG. 4 provides an inner view of the pillow of FIG. 3.

FIG. 3 provides an outer view of a second embodiment of a pillow 100 in accordance with this disclosure. FIG. 4 provides an inner view of the pillow 100 of FIG. 3. As shown, the second embodiment shown in FIGS. 3 and 4 is very similar to the embodiment shown in FIGS. 1 and 2 and elements of the embodiment are labeled similarly. However, as shown, the second embodiment is provided with a third pocket 300 centrally located on the inner surface 170 of the corresponding elongated main body 110.

In some embodiments, the elongated main body 110 of the pillow 100 is filled with a granular fill, such as a polyfil. In other embodiments, the elongated main body 110 has a single piece foam fill. The elongated main body 110 may be provided with a removable cover that is washable independently of the pillow itself.

The removable cover may be provided with a large bottom zipper 310 located for easy removal of the cover and positioned so that it does not touch a user's body. The removable cover may be made with a variety of materials, including, for example, a soft jersey knit made of 97% cotton and 3% lycra, so that the removable cover can stretch enough to fit back on the elongated main body 110 after washing. Additional covers may be made available as well. Alternatively, polyester/cotton woven fabrics may used.

Further, the elongated main body 110 may be covered in cotton ticking, such that it may be washed as well.

The strap 250 may be made of the same fabric as the pillow, such that it is soft and comfortable on a user's neck. The removable closures at each end, such as Velcro closures, may be provided so that the strap 250 can be opened and the pillow 100 removed and repositioned with either arm by the user. The strap 250 may be adjustable, or may be provided with an elongated Velcro section to adjust to accommodate users of different heights.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A pillow comprising:

an elongated main body having a first end and a second end and a length from the first end to the second end, a first notch at a top edge of the elongated main body adjacent the first end, a second notch at the top edge of the elongated main body adjacent the second end, a first pocket at an inner surface of the elongated main body below the first notch and between the first notch and a bottom edge of the elongated main body, a second pocket at the inner surface of the elongated main body below the second notch and between the second notch and the bottom edge of the elongated main body, a first vertical groove and a second vertical groove, each along the inner surface of the elongated main body and extending from the top edge to the bottom edge, wherein the first vertical groove divides a first side segment of the pillow from a middle segment and the second vertical groove divides a second side segment of the pillow from the middle segment, wherein the first side segment has the first notch and the first pocket, and wherein the second side segment has the second notch and the second pocket, an upper edge of the first pocket being substantially similar in shape to the first notch and an upper edge of the second pocket being substantially similar in shape to the second notch, wherein the middle segment does not have a pocket, and wherein the pillow folds along the first and second vertical grooves such that it can wrap around a user.

2. The pillow of claim 1 further comprising a first temperature control element located in the first pocket and a second temperature control element located in the second pocket.

3. The pillow of claim 2, wherein the first temperature control element and the second temperature control element are removable.

4. The pillow of claim 2, wherein the first and second pockets are sealed.

5. The pillow of claim 2, wherein the first temperature control element and the second temperature control element are ice packs.

6. The pillow of claim 1, wherein the first notch and the second notch each have an inner lip and an outer lip, and wherein the outer lip of each notch is adjacent the corresponding edge of the elongated main body, and wherein the inner lip of each notch is adjacent a middle section of the pillow.

7. The pillow of claim 6 further comprising a strap, wherein the strap extends from the inner lip of the first notch to the inner lip of the second notch.

8. The pillow of claim 7, wherein the strap is releasably fixed to the elongated main body at the inner lip of the first notch and the inner lip of the second notch.

9. The pillow of claim 8, wherein the strap is releasably fixed at each end by a hook and loop connection.

10. The pillow of claim 1, wherein the elongated main body is filled with a granular fill.

11. The pillow of claim 1, wherein the elongated main body has a single piece foam fill.

12. The pillow of claim 1, wherein the elongated main body has a removable cover that can be washed independently of the pillow.

13. The pillow of claim 1, wherein the elongated main body comprises three discrete pillow chambers, with a first chamber containing the first notch, a second chamber containing the second notch, and a third chamber being a central chamber between the first and second chambers.

* * * * *